US005518186A

United States Patent [19]

Weinstein

[11] Patent Number: 5,518,186

[45] Date of Patent: May 21, 1996

[54] VOLTAGE BLOCK FOR ELECTROSTATIC SPRAYING APPARATUS

[75] Inventor: Richard Weinstein, Toledo, Ohio

[73] Assignee: Asahi Sunac Corporation, Japan

[21] Appl. No.: 436,913

[22] Filed: May 8, 1995

Related U.S. Application Data

[63] Continuation of Ser. No. 157,741, Nov. 24, 1993, abandoned.

[51] Int. Cl.[6] ..... B05B 5/16

[52] U.S. Cl. ..... 239/690; 118/629

[58] Field of Search ..... 239/690, 691, 239/708; 118/688, 693, 694, 629, 627

[56] References Cited

U.S. PATENT DOCUMENTS

| | | | |
|---|---|---|---|
| 3,122,320 | 2/1964 | Beck et al. | 239/3 |
| 4,275,834 | 6/1981 | Spanjersberg et al. | 239/691 |
| 4,313,475 | 2/1982 | Wiggins | 239/691 |
| 4,792,092 | 12/1988 | Elberson et al. | 239/3 |
| 4,884,752 | 12/1989 | Plummer | 239/691 |
| 5,078,168 | 1/1992 | Konieczynski | 137/566 |
| 5,094,389 | 3/1992 | Giroux et al. | 239/691 |
| 5,197,676 | 3/1993 | Konieczynski et al. | 239/690 |
| 5,249,748 | 10/1993 | Lacchia et al. | 239/690 |
| 5,255,856 | 10/1993 | Ishibashi et al. | 239/691 |
| 5,310,120 | 5/1994 | Ehinger et al. | 239/690 |

*Primary Examiner*—Karen B. Merritt
*Attorney, Agent, or Firm*—David C. Purdue; John C. Purdue

[57] ABSTRACT

A voltage block device for use with electrostatic spraying apparatus for conductive coatings is disclosed. The device maintains an air gap which electrically isolates a grounded paint supply from a charged spray head to prevent the leakage of potential to the grounded paint supply. The device comprises a tube made of non-conductive material and having ends which are closed by upper and lower caps to define a closed space which is pressurized. A valve secured in the upper cap delivers paint into the closed space to raise the level of conductive coating material therein to the level of an external sensor. In a first mode of operation, valve interlock circuitry opens the valve when the spray head is not charged and the sensor detects a low level of coating material. The valve closes if the level of conductive coating material in the closed space reaches the external sensor or the spray head becomes charged, restoring an air gap which electrically isolates the grounded paint supply. In a second mode of operation, the valve interlock circuitry includes a timer and opens and closes the valve intermittently, when needed, so it dispenses discreet bodies of conductive coating material separated from each other, the upper cap and the conductive coating material in the cylinder by one or more air gaps having a combined length sufficient to electrically isolate the grounded paint supply. This valve cycle is repeatable and permits continuous charged operation of the spray head.

14 Claims, 5 Drawing Sheets

VOLTAGE BLOCK FOR ELECTROSTATIC SPRAYING APPARATUS

This application is a continuation of application Ser. No. 08/157,741 filed Nov. 24, 1993, now abandoned.

BACKGROUND OF THE INVENTION

1. Field of the Invention

This invention relates to the field of apparatus for electrostatic or high voltage spray coating. More specifically, the invention relates to voltage blocks for electrically isolating a supply of conductive coating material from a source of electric charge, for example, an electrostatic spray head.

2. Description of the Prior Art

Electrostatic spraying is employed primarily in the field of palm application. In electrostatic spraying apparatus, paint or the like is drawn from a paint pot and delivered to and through a spray nozzle. A high potential is applied to the paint in the vicinity of the spray nozzle so that charged paint is discharged from the nozzle. In a known manner, the charged paint particles are selectively attracted to the articles to be painted or coated.

Many solvent based paints have a relatively low conductivity and a correspondingly high resistivity. Solvent based paints with low conductivity are typically supplied directly from an electrically grounded palm pot to a charged spray head. Because such solvent based coatings do not provide a significant electrical path for the potential applied to the paint in the spray head, i.e., they do not create a short circuit back to the grounded paint pot, such solvent based coatings can be adequately charged at the spray head. Waterborne paints and other coatings are highly conductive, however, and they provide a path through which a charge can and does create a short circuit from a charged spray head to a paint supply container at ground potential. Thus, special equipment is needed to apply conductive coating materials such as waterborne paint electrostatically, Because of the known hazards attributable to the use of solvent based paint systems, there is a preference for using waterborne paints and coatings, despite the need to electrically isolate the high voltage used in electrostatic spraying equipment from the paint pot from which waterborne paint is drawn. This problem has been addressed in three primary ways. In a first approach, the paint pot is electrically isolated from ground potential and is charged to substantially the same potential as the spray head so that there is no tendency for a charge to leak from one to the other or to ground. In the second and third approaches, a grounded paint pot delivers grounded conductive coating material to a spray head by way of a voltage block device. In one known voltage block device, an intermediate paint pot is filled while it is electrically isolated from the charged spray head. When filling is completed, the intermediate paint pot is electrically disconnected from the grounded paint pot and is connected to the charged spray head. In some embodiments of this type of voltage block device, a pair of intermediate paint pots are provided along with valving to alternatively connect and disconnect first one intermediate pot and then the other from the charged spray head. The unconnected intermediate paint pot is then filled before it is reconnected to the spray head. A second type of known voltage block device comprises a single intermediate paint pot and a paint feed line which includes a pneumatically operated metal tube movable between a first position in which it connects the intermediate paint pot and the grounded paint pot and a second position in which it creates an air gap of suitable length between the intermediate paint pot and the grounded paint pot. When no charge is being applied to the system, the tube is moved to the first position and the intermediate paint pot is filled. Before the system is charged, the tube is moved to the second position to electrically isolate the paint in the intermediate pot and a charge is applied to the spray head and the intermediate paint pot.

U.S. Pat. No. 3,122,320 (Beck et al.) discloses apparatus for electrically isolating a paint supply from the charge applied to an electrostatic spray head. In this apparatus, paint from a grounded paint supply is "sprayed or otherwise broken into discrete particles by [passing through a] perforated head 18" (column 1, lines 69 and 70). In other embodiments disclosed in the patent, paint at ground potential is delivered to an intermediate vessel (30 in FIGS. 2A and 2B; 31 in FIGS. 3A and 3B) which, when filled, is disconnected (and electrically isolated) from the grounded paint supply and connected to a charged paint pot 10 into which the paint is dispensed from the intermediate vessel (30 or 31).

U.S. Pat. No. 5,078,168 (Konieczynski et al.) discloses a two stage voltage block for electrically isolating an electrically grounded paint supply from a charged electrostatic spray head. Each of the two stages include shuttle devices and reservoir piston pumps. These stages are connected in series. The first stage is connected to a grounded paint supply and the second stage and the second stage is connected to the first stage and to one or more electrostatic spray heads. The first stage alternately draws conductive coating material from a grounded paint supply and delivers the conductive coating material to the second stage. The second stage alternately draws paint from the first stage and delivers it to one or more spray heads.

U.S. Pat. No. 5,1.97,676 (Konieczynski) discloses a device comprising the two stage voltage block described in Konieczynski et al., with individual voltage blocks interposed between the second stage of the Konieczynski et al. voltage block and individual spray heads.

U.S. Pat. No. 4,884,752 (Plummer) discloses a voltage block device with two chambers which are alternately connected to a grounded supply of paint for filling (while disconnected from a charged spray head) and connected to a spray head for discharging paint (while disconnected from a source of grounded paint). Supply and discharge hoses associated with the chambers are purged and dried to provide an air gap to electrically isolate the chambers.

U.S. Pat. No. 4,792,092 (Elberson et al.) discloses an improved version of the voltage block disclosed in Plummer wherein the two chambers comprise helical tubing.

SUMMARY OF THE INVENTION

The instant invention is based upon the discovery of an improved voltage block device especially suited for use in conjunction with electrostatic spraying apparatus for waterborne or other conductive coatings. The invention is based upon the further discovery of improved methods for electrostatically applying conductive coatings. In a voltage block according to the invention, an air gap electrically isolates a grounded paint supply from a spray head, whenever it is charged, to prevent the leakage of potential to the grounded paint supply. The voltage block device comprises a tube or the like made of non-conductive material and having ends which are closed by upper and lower caps to define a closed space. The closed space is pressurized by means of a self relieving air valve which receives compressed air or the like and discharges it into the closed space to establish and maintain a fixed, substantially constant pressure which is used to deliver conductive coating material at a desired flow rate to and through a charged spray device. A valve secured in the upper cap delivers paint into the closed space, under a pressure which is higher than the maximum pressure which is maintained in the closed space, to raise the level of conductive coating material in the closed space up to the level of an external sensor while maintaining an air gap of at least a minimum given length between the reservoir of conductive coating material in the closed space and the valve in the upper cap during the times that a spray head which draws coating material from the reservoir is charged. The operation of the valve is controlled by a controller. In one embodiment, the device includes valve interlock circuitry which prevents the valve from opening when the power supply is actuated. When the power supply is not actuated, and the sensor detects a low level of coating material in the closed space, the valve opens and remains open until level of conductive coating material in the closed space reaches the external sensor. If, however, the power supply is actuated during a time when the valve is open, the valve interlock circuitry will instantly shut off the valve, restoring an air gap in the closed space which electrically isolates the grounded paint supply from the charged spray head. In a second embodiment, the valve interlock circuitry includes a timer which is preset to open and close the valve intermittently, when a low level of coating material in the closed space is detected by the sensor. The timer is preset to hold the valve open for a period of time only sufficient to dispense a discreet body of conductive coating material having a leading end, a trailing end and a given length. The given length of the bodies so dispensed is controlled, relative to the given minimum length of the air gap to be maintained in the closed space, so that the total, cumulative length of the air gaps between the upper cap and the trailing end of a discreet body and between the leading end of the discreet body and the conductive coating material in the lower end of the closed space is sufficient to prevent the leakage of high voltage from the coating material in the lower end of the closed space, when charged, to the grounded upper cap and the valve. The timer is preset to keep the valve closed for a sufficient length of time to create an air gap between the trailing end of a first discreet body and the leading end of a subsequent discreet body. The timer is preset so that, at all times during a valve cycle, i.e., the valve opening, the valve closing and the time intervals between each event, the total length of air gaps in between the upper cap and one or more discreet bodies and the upper surface of the conductive coating material in the lower end of the tube, is sufficiently long to prevent the leakage of high voltage to the grounded upper cap and valve. The valve cycle will repeat so long as the sensor indicates a need for additional conductive coating material. When operated in this manner, the voltage block will support a continuous charged spraying operation by delivering pressurized conductive fluid to a spray nozzle(s).

DETAILED DESCRIPTION OF THE INVENTION

Figure 1:
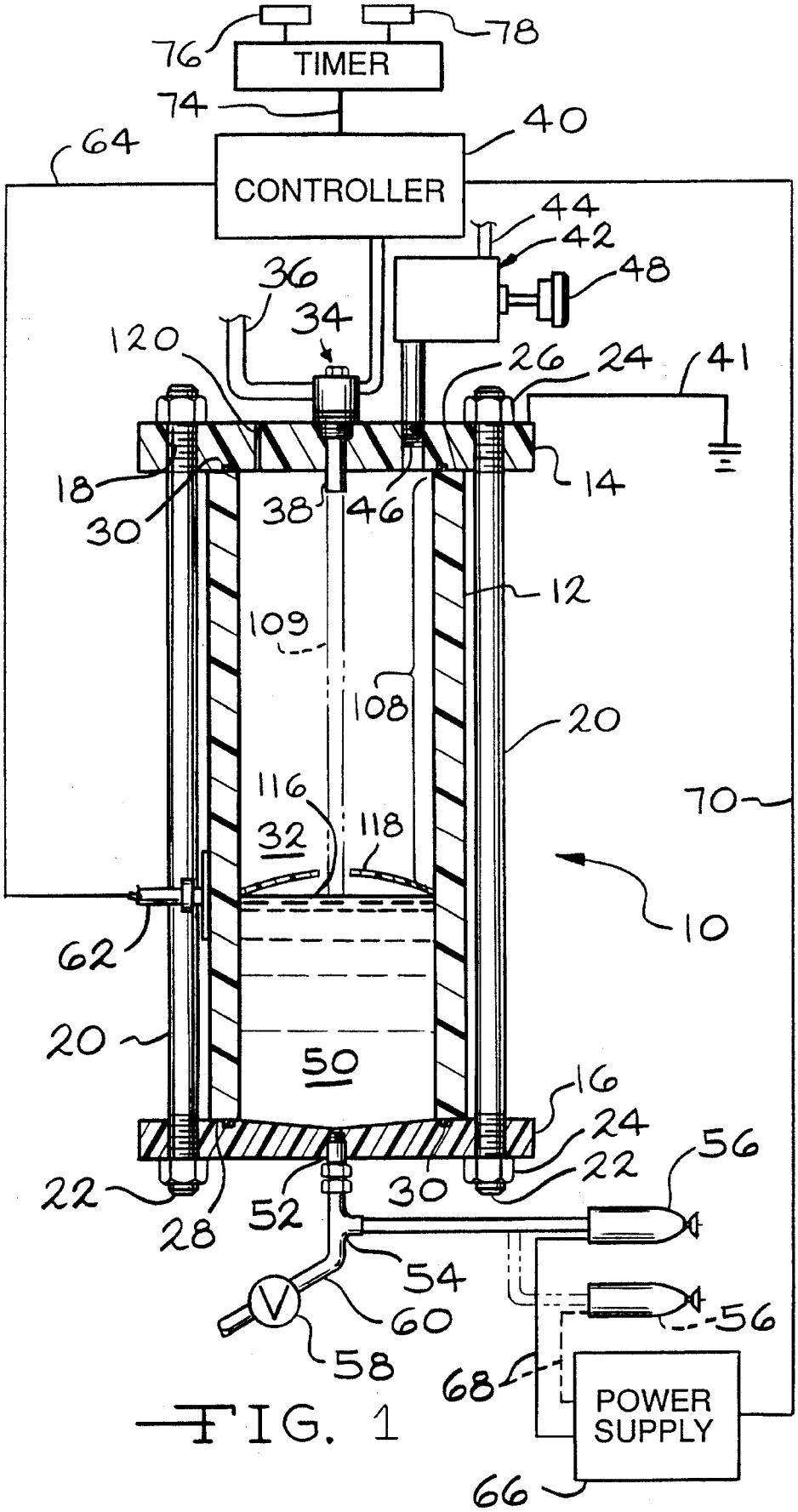
FIG. 1 is partially schematic view of a voltage block device according to the present invention, during a fill sequence in MODE I operation.

Referring now to FIG. 1, a voltage block device according to the present invention is indicated generally at 10. The device 10 comprises a cylinder 12 which is preferably formed of glass but can be formed of a polymeric material or another suitable material, i.e., one which is strong and non-conductive. The upper end of the cylinder 12 is closed by a cap 14 and the lower end of the cylinder 12 is closed by a cap 16. In the embodiment illustrated in FIG. 1, the upper and lower caps 14 and 16 have a diameter which is greater than the diameter of the cylinder 12 and a plurality of apertures 18 are formed in the upper and lower caps 14 and 16. A plurality of non-conductive rods 20 with threaded ends 22 extend through the apertures 18 and the threaded ends 22 cooperate with nuts 24 to secure the caps 14 and 16 tightly against upper and lower ends 26 and 28 of the cylinder 12. Preferably, O-rings 30 are positioned between the upper cap 14 and the upper end 26 of the cylinder 12 and also between the lower cap 16 and the lower end 28 of the cylinder 12 to provide a tight seal therebetween. The elements thus far described define a closed space 32 which can be pressurized up to at least 50 psi.

An electrically or pneumatically controlled valve, indicated generally at 34, is secured in the upper cap 14. The valve 34 has an inlet 36 which is outside the closed space 32 and an outlet 38 which is in communication with the closed space 32. The valve 34 is connected to a controller 40 which is operable to control the opening and closing of the valve 34 in ways that are described below in detail. Conductive coating material is supplied to the valve inlet 36 under pressure from a paint room (not shown) commonly referred to as a "kitchen." Preferably, the coating material is supplied to the inlet 36 at a pressure greater than about 50 psi. The coating material is supplied at a substantially ground or zero potential. The upper cap 14 is grounded, as at 41 so that it and the items mounted in or on it remain at ground potential during charged spraying operations. The device 10 can be set to operate so that the valve 34 opens and remains open until the desired level of coating material is achieved in the lower end of the closed space, subject to being closed instantly if the spray head is actuated. The device 10 can also be set to operate so that the valve, when actuated, opens and closes intermittently, and a sufficient air gap is maintained in the cylinder to maintain the upper cap and associated elements at ground potential, even during charged spraying operations.

A self-relieving pressure regulator, indicated generally at 42, is secured in the upper cap 14. The regulator 42 has an inlet 44 for receiving air or the like, at a pressure preferably above 50 psi, from a source (not shown) for pressurized air or the like. The regulator 42 has an outlet 46 which is in communication with the closed space 32. When the device 10 is operated, as described below in more detail, supply air, under pressure, enters the inlet 44 of the regulator 42 and is delivered, at a predetermined pressure of approximately 40 psi, through the regulator outlet 46 into the closed space 32, whenever the pressure in the closed space drops below about 40 psi. The regulator 42 is set to relieve pressure from the closed space 32 when pressure therein exceeds a predetermined pressure of approximately 45 psi. This relief pressure setting can be made by adjusting a knob 48 on the regulator 42.

Conductive coating material 50 delivered into the closed space 32 through the valve 34 collects in the lower end of the closed space 32 and is discharged, under appropriate conditions, from the closed space 32 through a fitting 52 which is secured in an aperture in the lower cap 16. The fitting 52 is adapted to connect to a sprayer supply hose assembly 54 which conducts the coating material 50 to one or more spray heads 56. A normally closed valve 58 is provided in a discharge conduit 60 which branches off of the sprayer supply hose assembly 54. When the valve 58 is opened, conductive coating material 50 or a solvent can be flushed from the device 10 to facilitate a color change or the like.

Means for creating a signal indicating when the level of conductive coating material 50 in the cylinder is below a given level, preferably comprising a liquid level proximity sensor, is indicated at 62. The sensor 62 is secured to the outside of the cylinder 12, above the lower end 28 of the cylinder 12, but well below the upper end 26 of the cylinder 12. The sensor 62 is preferably a capacitance type which emits a signal to detect the presence or absence of liquid in the cylinder 12, adjacent to the sensor 62. The sensor 62 is operable to act as a switch which closes when the sensor 62 detects the absence of liquid in the cylinder 12, adjacent to the sensor 62. The sensor is further operable to act as a switch which opens in the event that the sensor 62 detects the presence of liquid in the cylinder 12, adjacent to the sensor 62. The sensor cooperates with other valve interlock circuit components (described below with reference to FIG. 5) to control the opening and closing of the valve 34.

Power for applying a potential to the spray head(s) 56, and the conductive coating material therein, is supplied by a power supply 66, via line 68, to the spray head(s) 56. The power supply is connected by a line 70 to the controller 40, through a relay circuit (discussed below with reference to FIG. 5) so that, when the power supply 66 is actuated, the relay circuit will open a switch in the valve interlock circuitry and, when the power supply is not actuated, the relay circuit will close a switch in the valve interlock circuitry.

Timer means, indicated generally at 72, are electrically connected to the controller 40 via a line 74. The timer means 72 is operable to act as a switch which closes and remains closed for an adjustable time interval and opens and remains open for an adjustable time interval. The timer 72 includes a control knob 76 for setting the time interval during which the timer 72 acts as a closed switch. The timer 72 includes a control knob 78 for setting the time interval during which the timer 72 acts as an open switch. The settings of the knobs 76 and 78 determine a repeatable cycle of open switch and closed switch conditions, each of a fixed, pre-determined duration.

Figure 5:
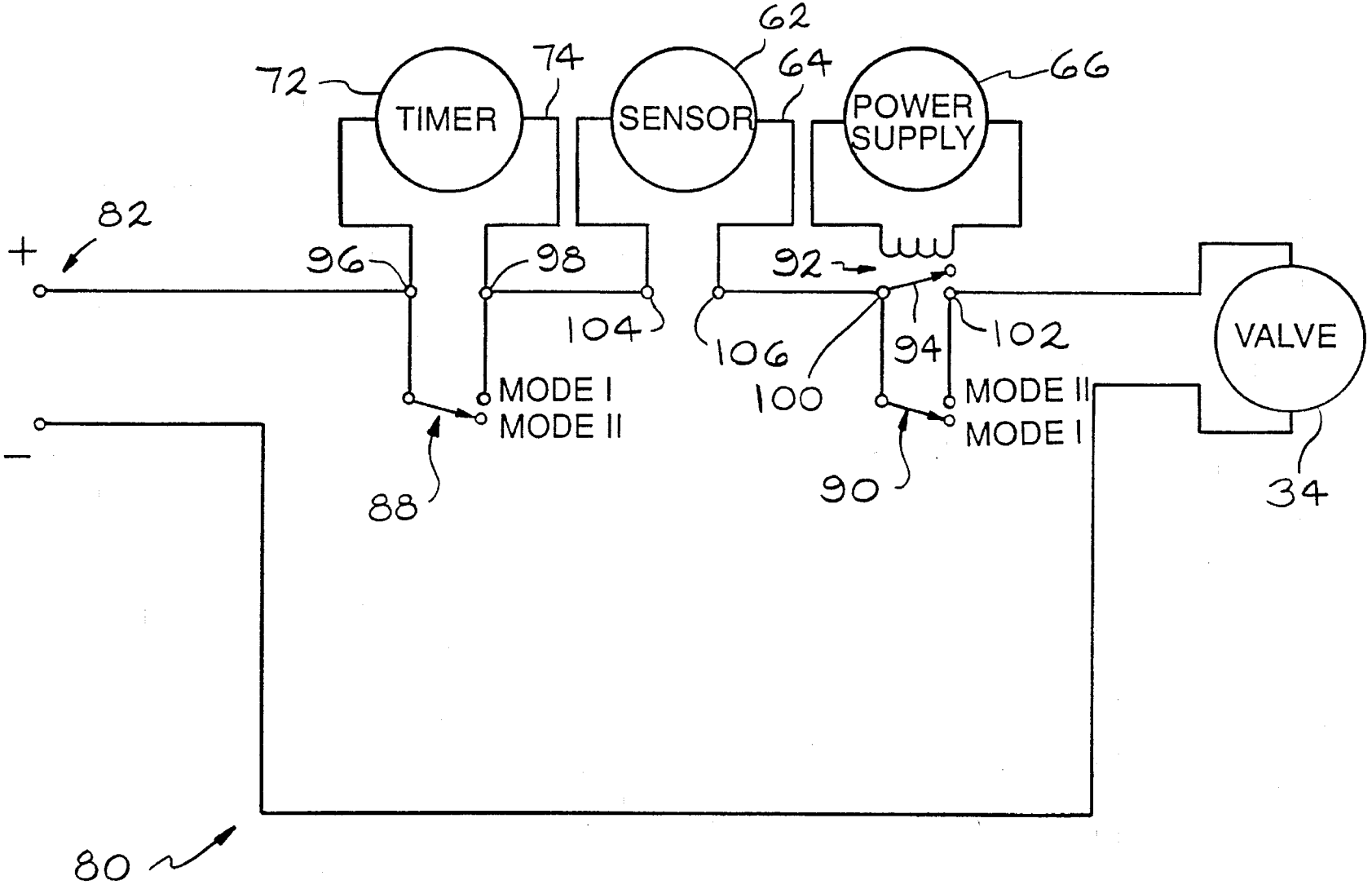
FIG. 5 is a schematic diagram of valve interlock circuitry for use in controlling the voltage block device during MODE I and MODE II operation.

Referring now to FIG. 5, valve interlock circuitry is indicated generally at 80. The specific circuit illustrated in FIG. 5 receives power at 82, preferably at 24 volts and, under the conditions described below, selectively actuates and de-actuates the valve 34, causing it to open and close, while electrically isolating the value 34 and the upper cap 14 from the potential applied to the spray head(s) 56. As previously indicated, the valve 34 may be electrically or pneumatically controlled. In the case where the valve is electrically actuated, the circuit 80 opens the valve 34 when it applies a potential to it. In case the valve is pneumatically controlled, the circuit 80 would apply a potential to and actuate pneumatic control means (not shown) which would, in turn, open the valve 34.

Manually operable switches 88 and 90 are used to select between operation of the device in MODE I and MODE II, as indicated by the legends adjacent to the switches 88 and 90. The circuit 80 further comprises a relay 92 which controls a switch 94. The relay 92 is controlled, in turn, by the power supply 66. When the power supply 66 is actuated, the relay 92 opens the switch 94.

The manually operable switch 88 is in parallel with the timer 72, between terminals 96 and 98. When switch 88 is closed, i.e., is in the MODE I position, the terminals 96 and 98 are electrically connected and the timer 72 is rendered ineffectual in the circuit 80, and has no effect on the operation of the valve 34. When the switch 88 is open, i.e., in the MODE II position, the timer 72 does control the operation of the valve 34 by making and breaking an electrical connection between the terminals 96 and 98.

The manually operable switch 90 is in parallel with the switch 94 of the relay 92, which is controlled by the condition of the power supply 66, across terminals 100 and 102. When switch 90 is open, i.e., is in the MODE I position, the power supply 66 controls the operation of the relay 92 which controls the valve 34. Specifically, when the power supply is actuated, the relay 92 will open the switch 94, electrically, disconnecting the terminals 100 and 102, rendering the circuit 80 incapable of opening the valve 34. In the event that the power supply 66 is actuated while the valve 34 is open, the relay 92 will open the switch 94, causing the valve 34 to close immediately. When switch 90 is closed, i.e., in the MODE II position, the relay 92 is rendered ineffectual in the circuit 80, and the condition of the power supply 66 will have no effect on the operation of the valve 34.

The sensor 62 is connected between first and second terminals 104 and 106. The sensor 62 is operable to electrically connect the terminals 104 and 106 when it fails to detect the presence of liquid in the cylinder 12, adjacent to the sensor 62. When the sensor 62 does detect the presence of liquid in the cylinder adjacent to the sensor 62, it is operable to break the electrical connection between the terminals 104 and 106.

The operation of the device 10 in MODE 1 and MODE II will now be described with reference to FIGS. 1 through 5. It will be appreciated by those skilled in the art of controllers including programmable controllers, from the following description, that the valve interlock circuitry illustrated in FIG. 5 can take many forms other than that illustrated in FIG. 5, and still perform the functions described below.

OPERATION OF DEVICE 10 DURING INTERMITTENT SPRAY GUN OPERATION (MODE I)

In coating operations in which conductive coating material is to be applied intermittently, the device 10 could be operated in MODE 1 in the following manner, starting from a point where there is no conductive coating material in the cylinder 12 and the power supply 66 is not actuated.

INITIALIZATION

The manually operated switches 88 and 90 are set to MODE I. As a consequence, the timer 72 does not control the operation of the valve 34. The operation of the valve 34 is controlled by the liquid level proximity sensor 62 and the condition of the power supply 66. With no conductive coating material in the cylinder 12, the sensor 62 will electrically connect the terminals 104 and 106. With the power supply 66 not actuated, the relay 92 will close the switch 94. The circuit 80 is now closed through switches 88 and 94 and terminals 104 and 106 are electrically connected so that, when power is applied to the circuit 80 at 82, the circuit will apply a potential to the valve 34 causing it to open and dispense a continuous stream 109 (FIG. 1) of conductive coating material into the cylinder 12. The valve 34 will continue to dispense a stream 109 of conductive coating material into the cylinder 12 until the volume of conductive coating material in the cylinder 12 is such that the upper surface of the conductive coating material in the cylinder is adjacent to the liquid level proximity sensor 62, substantially as shown in FIG. 1. At that point in time, the sensor 62 will break the electrical connection between terminals 104 and 106, causing the circuit 80 to close the valve 34. This condition in which the conductive coating material fills the portion of the cylinder 12 below the sensor 62 is referred to hereinafter as a full reservoir condition. Initialization is complete at this time and there is a full reservoir of conductive coating material 50 in the lower end of the cylinder 12. The device 10 is now set for operation of the spray head(s) 56 and the concurrent actuation of the power supply 66.

When the valve 34 is closed, a voltage block comprising an air gap 108 and consisting of the untilled portion of the closed space 32 electrically isolates conductive coating material 50 in the lower end of the cylinder 12 from the upper cap 14, conductive coating material in the valve 34, the inlet 36 and the "kitchen."

APPLICATION OF COATING MATERIAL AFTER INITIALIZATION (MODE I)

The spray head(s) 56 is actuated and, concurrently, the power supply 66 is actuated to apply a high potential to the spray head(s) 56 and conductive coating material therein. This charge will be conducted by the coating material in the supply hose assembly 54 to the coating material 50 in the lower end of the cylinder 12 which, as explained above, is electrically isolated from the upper cap 14 and the rest of the conductive coating material in the system by the air gap 108.

When the power supply 66 is actuated, the relay 92 opens the switch 94. If this occurs while the valve 34 is open, the relay 92 will immediately break the electrical connection between terminals 100 and 102. As a consequence, the circuit 80 will be broken causing the valve 34 to close, thereby re-establishing the air gap 108 in the closed space 32. If the switch 94 is opened while the valve 34 is closed, opening of the valve 34 will be prevented until the power supply 66 is turned off and the switch 94 closes.

When the power supply 66 is not actuated, the actuation of the valve 34 will be controlled solely by the liquid level proximity sensor 62 so that the valve 34 will be opened whenever the sensor 62 senses the need to replenish the conductive coating material in the lower portion of the cylinder 12.

The spray head(s) 56, when actuated, dispenses charged conductive coating material, drawing down the level of conductive coating material 50 in the cylinder 12 below the sensor 62. The coating material is discharged under a pressure of about 45 psi or any desired pressure under 50 psi which is maintained inside the closed space 32 of the cylinder 12 by the pressure regulator 42. The spraying is continued while one or more work-pieces (not shown) are coated and the spraying is discontinued when a desired number of pieces are coated. When spraying is stopped, the power supply 66 is turned off and the relay 92 closes the switch 94 which, when open, prevented the valve 34 from operating, even in the case where the sensor 62 electrically connected the terminals 104 and 106. With the switch 94 closed because the power supply 66 is off and terminals 104 and 106 electrically connected because the level of the conductive coating in the cylinder 12 is below the level of the sensor 62, the valve 34 opens so that a stream 109 of conductive coating material flows through the valve 34 into the closed space 32 to replenish the supply of coating material. The filling continues until either the level of conductive coating material 50 in the cylinder 12 reaches the sensor 62, causing the terminals 104 and 106 to be electrically disconnected, or until the spray head(s) 56 is actuated, causing the power supply 66 to be actuated and the switch 94 to open, whichever occurs first.

OPERATION OF DEVICE 10 DURING CONTINUOUS SPRAY GUN OPERATION (MODE II)

In coating operations in which conductive coating material is to be applied intermittently or substantially continuously, the device 10 could be operated in MODE II in the following manner, starting from a point where there is no conductive coating material in the cylinder 12 and the power supply 66 is not actuated.

In order to operate the device 10 in MODE II, the manually operated switches 88 and 90 are set to the MODE II positions. With switch 90 closed, in the MODE II position, the circuit 80 can be closed and the valve 34 opened, without regard to whether or not the power supply 66 is on or off. With switch 88 open, in the MODE II position, the circuit 80 can only be closed during the on sequence of the on-off cycle of the timer 72. As in MODE I operation, the circuit 80 can only be closed when the sensor 62 senses the need to replenish the supply of conductive coating material in the cylinder 12. Thus, in MODE II, the valve 34 is controlled by the sensor 62 and the timer 72. When the sensor 62 senses that the level of conductive coating material in the cylinder 12 has fallen below the level shown in FIG. 1, the valve 34 is opened and closed for preset intervals of time so that discreet bodies of coating material are discharged from the outlet 38. The discreet bodies have a predetermined length and are separated, one from another as well as from the valve 34 and the reservoir of coating material in the lower end of the cylinder, by air gaps having a sufficient combined length to prevent leakage of high voltage back to the upper cap 14, the valve 34, and the grounded paint pot (not shown). The spray head(s) 56 can be operated in MODE II, even during the times that the valve 34 is being opened and closed intermittently, without leakage of high voltage applied by the power supply 66.

The operation and operating parameters of the invention during MODE II operation are described below in the context of a device 10 having a cylinder 12 which is approximately 20 inches long and, preferably, an internal diameter of 2 to 3 inches. The sensor 62 is located at least 10 inches (25 cm) below the upper cap 14. Other dimensions may be employed consistent with the operating parameters outlined below.

INITIALIZATION

Figure 2:
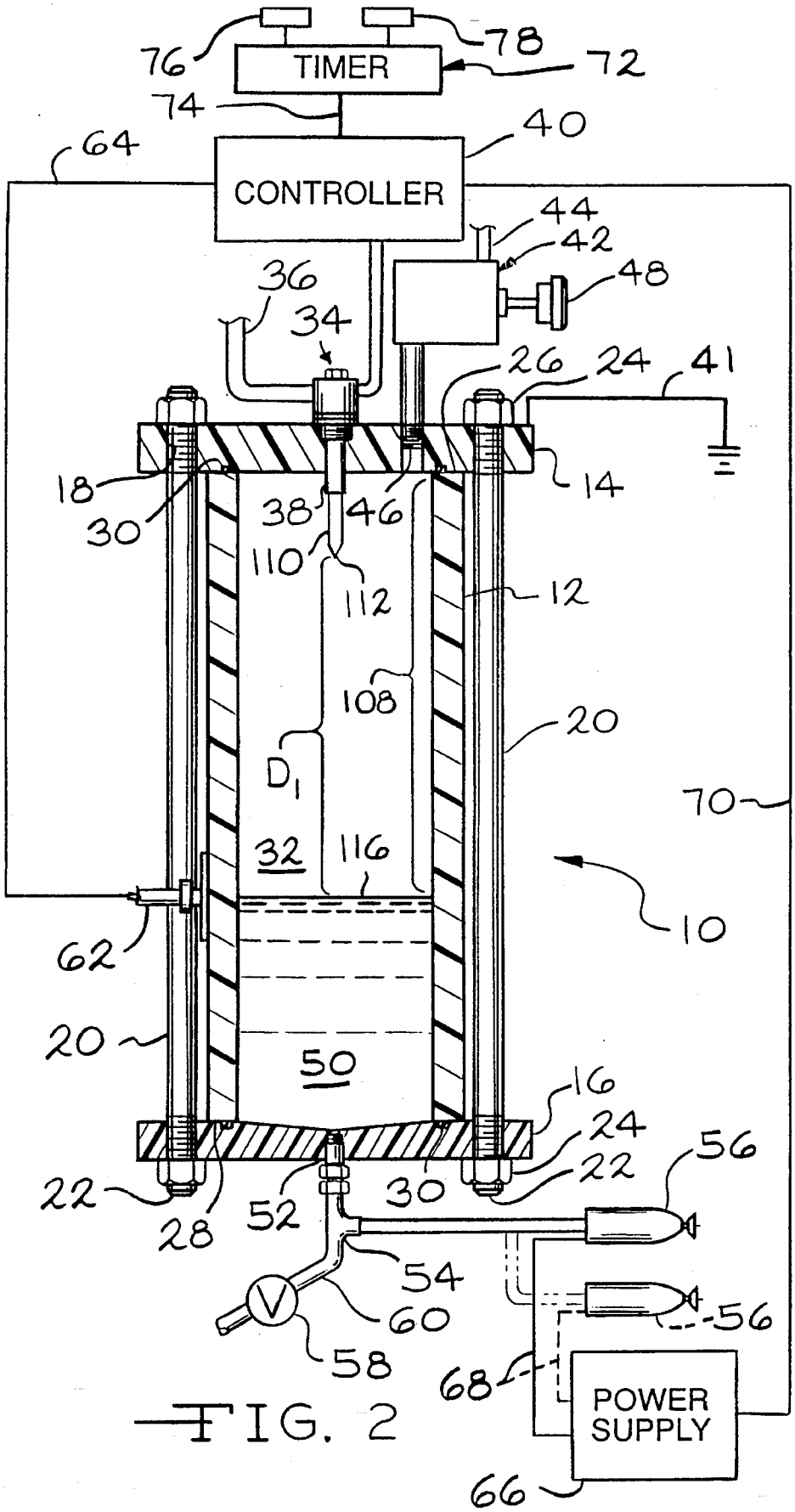
FIG. 2 is a view, similar to FIG. 1, showing a body of conductive coating material leaving a valve outlet and entering a cylinder in the voltage block device, during a fill sequence in MODE II operation.
Figure 3:
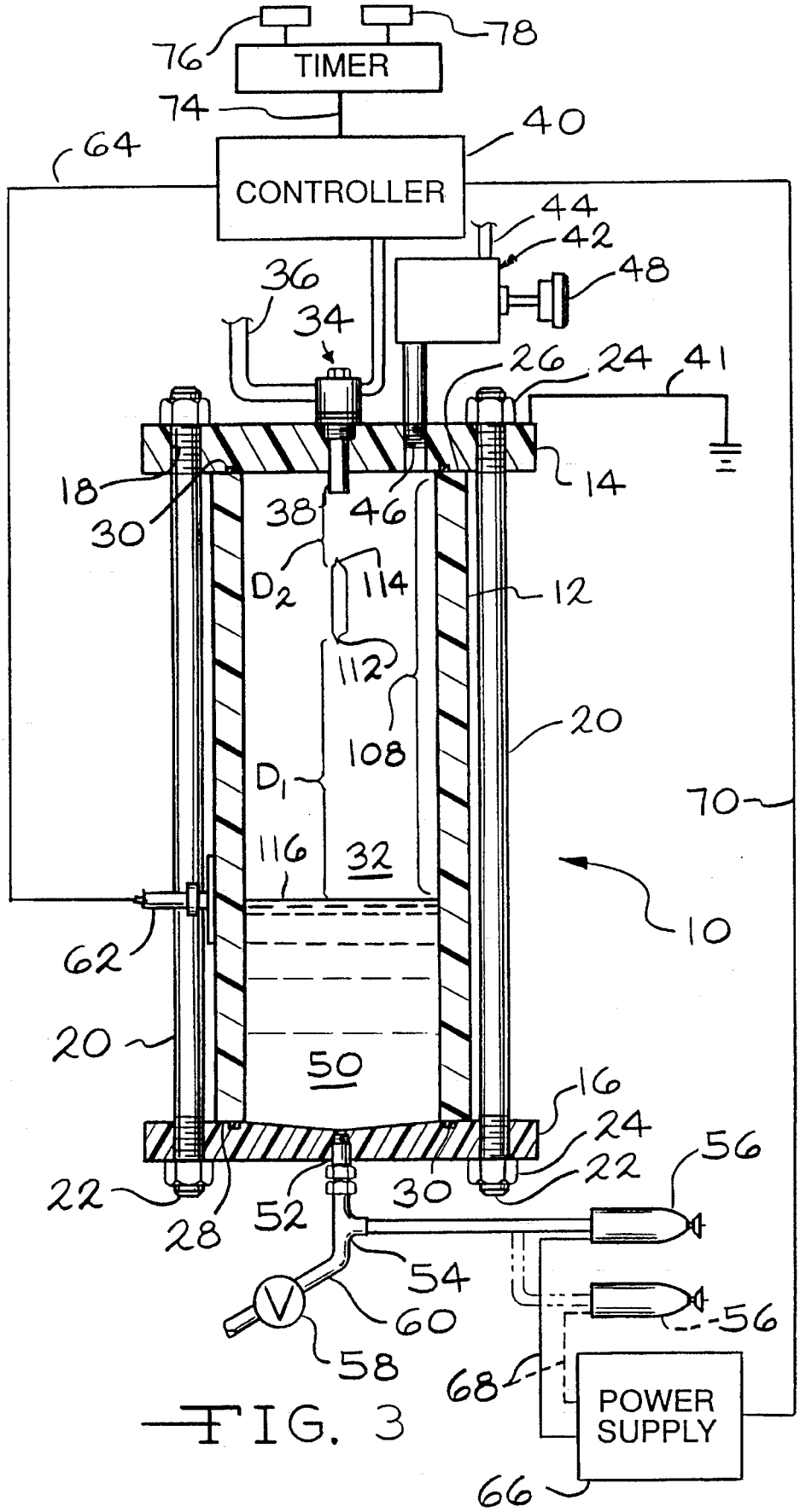
FIG. 3 is a view, similar to FIG. 2, showing a body of conductive coating material entering falling in a cylinder in the voltage block device, during MODE II operation.

Manually operable switches 88 and 90 are set to the MODE II positions. The timer 40 is pre-set, by adjustment of knobs 76 and 78, so that the terminals 96 and 98 are intermittently connected and disconnected electrically. The timer 72 connects and disconnects the terminals 96 and 98, causing the valve 34 to open, to stay open for a controlled period of time, to close, to stay closed for a controlled period of time and then to repeat the cycle. This sequence of timer operation is controlled so that, when the sensor connects the terminals 104 and 106, the valve 34 opens and stays open only long enough that a discreet, longitudinally extending body 110 (a portion of the body is shown in FIG. 2; a complete body 110 is shown in FIG. 3) of conductive coating material is dispensed from the valve outlet 38 into the closed space 32 where it falls to the lower end of the cylinder 12. The body 110 has a leading end 112 (FIGS. 2 and 3) and a trailing end 114 (FIG. 3). In MODE II operation, the length of the body 110 is controlled by controlling the length of the time interval during which the timer 72 electrically connects the terminals 96 and 98, and thereby controlling the length of time that the valve 34 remains open. It is believed that the length of the body 110 will be influenced by the pressure under which conductive coating material is discharged from the valve outlet 38, the pressure in the closed space 32 and the viscosity of the coating material. Presently, in a device having the dimensions set forth above, it is preferred that each body 110 of conductive coating material have a length, from the leading end 112 to the trailing end 114, of approximately 4 inches (10 cm). After the timer disconnects the terminals 96 and 98, they remain disconnected long enough for the body 110 to fall within the closed space a substantial distance, preferably, until the trailing end 114 is approximately 10 inches below the valve outlet 38. At the end of an off cycle, the timer reconnects the terminals 96 and 98.

During initialization, the level of conductive coating material will be below the sensor 62 and it will connect the terminals 104 and 106. When power is applied to the circuit 80 as at 82, the valve 34 will open and close dispensing discreet bodies 110 into the closed space where they fall to and collect in the lower end of the cylinder 12. During this time, one can test the settings of the timer knobs 76 and 78 by actuating the spray head(s) 56 and the power supply 66, provided that it is equipped with a device (not illustrated) which indicates the potential applied by the power supply 66 to the spray head(s) 56. If full potential is being applied to the spray heads, i.e., potential is not leaking back through the valve 34 to the grounded paint pot, the settings are acceptable. In fact in this case, one can increase the duration of the on cycle of the timer 72 and/or decrease the duration of the off cycle, until potential begins leaking back through the valve 34, as would be indicated by a drop in the applied potential. When a leak condition is reached, (or if one is detected initially) one would decrease the duration of the on cycle of the timer 72 and/or increase the duration of the off cycle, until a no-leak condition is restored. Once the timer knobs 76 and 78 are properly set, initialization is complete. In the case where the cylinder 12 is made of a clear material such as glass, one can visually monitor the length of the bodies 110 while adjusting the duration of the on cycle of the timer 72 until bodies 74 having the desired length are produced.

Figure 4:
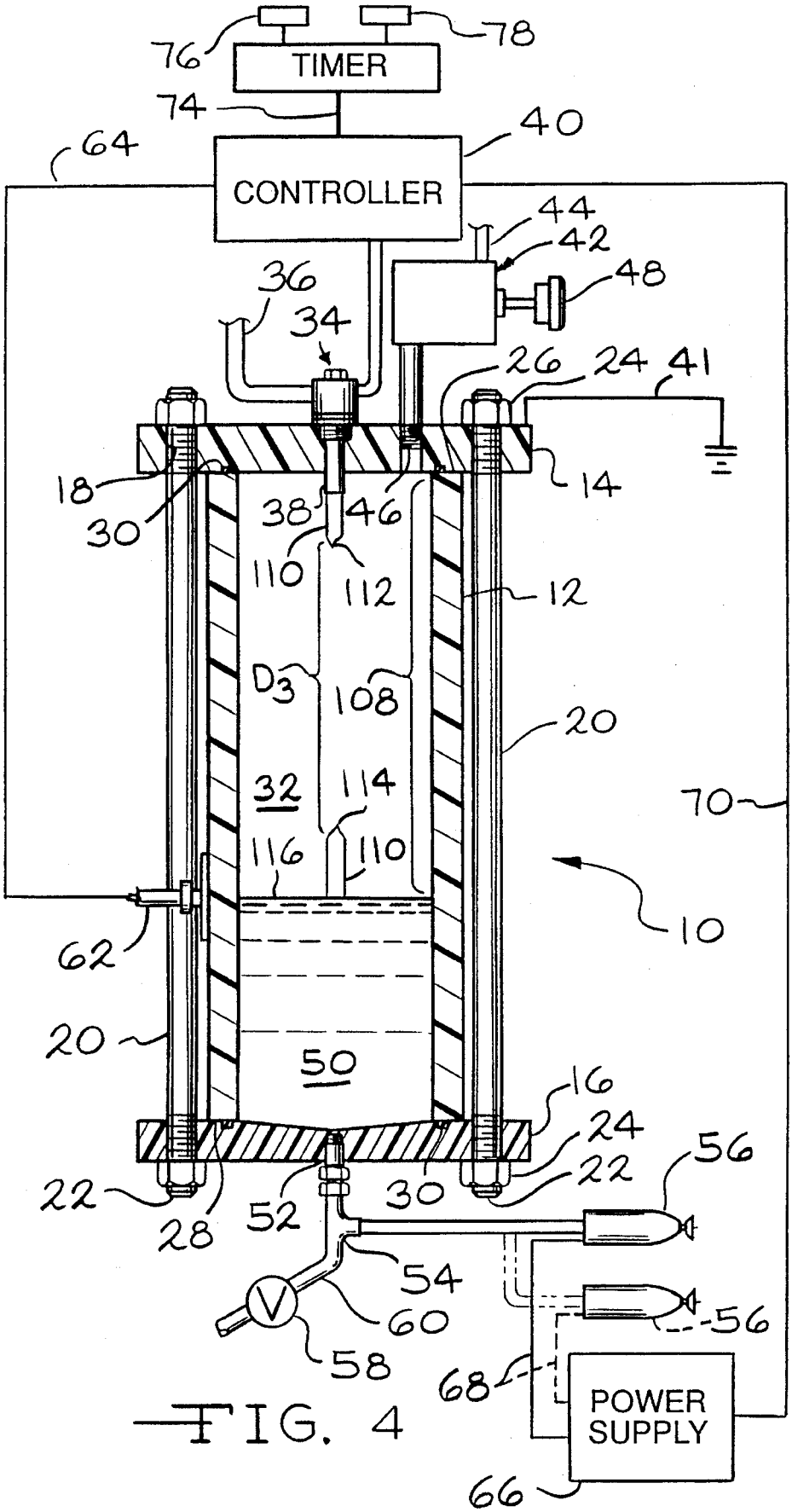
FIG. 4 is a view, similar to FIG. 3, showing a body of conductive coating material falling into a reservoir of conductive coating in the bottom of the cylinder in the voltage block device, and a second body of conductive coating material leaving a valve outlet and entering a cylinder in the voltage block device, during MODE II operation.

The relationship between the durations of the on and off cycles of the timer 72 can be further described in the context of distances D1 (FIGS. 2 and 3), D2 (FIG. 3) and D3 (FIG. 4). D1 is the distance between a leading end 112 of a body 110 and an upper surface 116 of the reservoir of conductive coating material 50 in the lower end of the cylinder 12. D2 is the distance between the valve outlet 38 and the trailing end 114 of the body 110 which has just left the outlet 38. D3 is the distance between a trailing end 114 of a body 110 which has left the outlet and the leading end 112 of the subsequent body that has been or is being dispensed from the outlet 38. D1, D2 and D3 are the distances of the air gaps in the cylinder 12 which, together, separate the valve outlet 38 from the charged conductive coating material 50 in the reservoir at the lower end of the cylinder 12. It will be appreciated that the distances D1 mad D2 will change constantly during operation of the device 10 because, whenever the sensor connects the terminals 104 and 106, bodies 110 will be dispensed from the outlet and fall into the reservoir of conductive coating material 50 in the lower end of the cylinder 12. D3 will be determined by the duration of the off cycle of the timer 72 although, it will be appreciated that the off cycle of the timer 72 may be set long enough so that, at all times, D3 remains zero inches. In order for the device 10 to be an effective voltage block, the timer 72 must be set so that, at all times, the sum total of the distances D1, D2 and D3 is sufficient to prevent voltage potential applied to the conductive coating material (and conducted to the reservoir of conductive coating material in the lower end of the cylinder) from leaking back through the valve outlet 38 to the valve 34 and the conducive coating material being supplied to the valve through the inlet 36.

In the case of a power supply that applies 100,000 volts to a spray head, the minimum air gap comprising the total distance of D1, D2 and D3 would be 5 inches although it is preferred to design and operate the device so that a minimum air gap of 10 inches is maintained, i.e., 1 inch for every 10 kilovolts. This will ensure, with a margin of safety, that there is maintained a sufficient air gap or gaps between the valve outlet 38 and the upper surface 116 of the coating material 50 in the lower end of the cylinder 12 so that the valve outlet 38, the upper cap 14 and associated parts are and remain electrically isolated from the coating material 50 in the lower end of the cylinder.

APPLICATION OF COATING MATERIAL AFTER INITIALIZATION (MODE II)

With the device 10 initialized for MODE II operation, the valve 34 is actuated and deactuated as the sensor 62 connects and disconnects, respectively, the terminals 104 and 106. This is true regardless of whether the power supply and the spray head(s) 56 are actuated and, when the power supply is actuated, the combined length of all air gaps D1, D2 and D3 is sufficient to prevent voltage from leaking back through the valve 34 back to the grounded paint supply (not shown). The device 10 can be dimensioned and operated to accommodate continuous spraying at substantial flow rates.

The foregoing description is intended to enable those skilled in the art to practice the present invention and constitutes the best mode presently known for practicing the invention. Undoubtedly, modifications will occur to those skilled in the art, and such modifications may be resorted to without departing from the spirit and scope of the invention disclosed herein and claimed below. For example, an anti splash device, indicated at 118 in FIG. 1, may be used to minimize splashing as the stream 109 or falling bodies 110 penetrate the upper surface 116 of the reservoir of conductive coating material 50 in the lower end of the cylinder 12. In addition, because humid air is more conductive than dry air, it may be desirable to provide means for controlling the humidity of the air in the closed space 32. Such means may comprise a vent fitting 120 which provides communication between the closed space 32 and the exterior of the cylinder 12 through a very small orifice so that relatively humid air is constantly vented, at a very low rate, from the closed space and replenished with pressurized air at a lower relative humidity delivered to the closed space 32 through the pressure regulator 42.

I claim:

1. A voltage block device for receiving a conductive coating material at substantially ground potential and for dispensing the coating material to an electrostatic spray head which, when actuated, is charged by a power supply, said device comprising a cylinder having upper and lower ends, said cylinder being composed of non-conductive material, upper and lower caps secured to the ends of the cylinder to define a closed space therein, a discharge outlet secured in said lower cap, said outlet being operable to dispense conductive coating material for delivery to an electrostatic spray head, a valve secured in said upper cap and having an inlet for receiving conductive coating material under pressure at substantially ground potential and an outlet for discharging said conductive coating material into said closed space, a sensor for sensing when the cylinder contains a full reservoir of coating material adjacent the lower end thereof, wherein said full reservoir of coating material has an upper surface which is spaced a distance D from the upper cap, a pressure regulator for receiving compressed gas and delivering it into the closed space to maintain a pressure therein, and a valve circuit including said sensor and operable to open said valve so that a stream of conductive coating material is dispensed into said cylinder where it falls into the reservoir of conductive coating material, only when said sensor senses that the cylinder contains less than a full reservoir of coating material and the spray head is not being charged by said power supply, said valve circuit being further operable to close said valve whenever said sensor senses that the cylinder contains a full reservoir of coating material or the spray head is being charged by said power supply, wherein, when said valve is closed, an air gap having a length corresponding with said distance D is maintained in the device and wherein said air gap is sufficiently long to prevent the leakage of potential from the reservoir of coating material to said upper cap and said valve.

2. The device claimed in claim 1 wherein said sensor is secured to the device, outside of the cylinder and wherein said sensor is a capacitance type which emits a signal to detect the presence or absence of liquid in the cylinder, adjacent to the sensor.

3. The device claimed in claim 1 wherein said valve is opened and closed by an electric solenoid which is included in said valve circuit.

4. The device claimed in claim 1 wherein said sensor is connected between two terminals in said valve circuit, wherein said sensor electrically connects said terminals when it senses a full reservoir condition and wherein said sensor electrically disconnects said terminals when it does not sense a full reservoir condition.

5. A voltage block device for receiving a conductive coating material at substantially ground potential and for dispensing the coating material to an electrostatic spray head which, when actuated, is charged by a power supply, said device comprising a cylinder having upper and lower ends, said cylinder being composed of non-conductive material, upper and lower caps secured to the ends of the cylinder to define a closed space therein, a discharge outlet secured in said lower cap, said outlet being operable to dispense conductive coating material for delivery to an electrostatic spray head, a valve secured in said upper cap and having an inlet for receiving conductive coating material under pressure at substantially ground potential and an outlet for discharging said conductive coating material into said closed space, a sensor for sensing when the cylinder contains a full reservoir of coating material, wherein said full reservoir of coating material has an upper surface which is spaced a distance D from the upper cap, a pressure regulator for receiving compressed gas and delivering it into the closed space to maintain a pressure therein, a timer operable to repeatably create a first signal of a duration O and a second signal of a duration C, and a valve circuit including said sensor and said timer and being operable, when said sensor senses that the cylinder contains less than a full reservoir of coating material, to repeatedly open said valve and keep it open for a length of time equal to the duration O and to close said valve and keep it closed for a length of time equal to the duration C, so that discreet bodies of conductive coating material are dispensed into said cylinder where they fall into the reservoir of conductive coating material in the lower end of the cylinder, said bodies, while falling, each having a substantially uniform length of B, wherein, at all times when said valve is dispensing such bodies, the distance D minus the combined length B of all bodies which are falling in the cylinder equals a distance corresponding with a total air gap in the device and wherein said total air gap is sufficiently long that it prevents the leakage of potential from the reservoir of coating material to said upper cap and said valve when the electrostatic spray head is actuated and is being charged by the power supply.

6. The device claimed in claim 5 which further includes means for adjusting the duration of said first and second signals created by said timer.

7. The device claimed in claim 5 wherein said sensor is secured to the device, outside of the cylinder and wherein said sensor is a capacitance type which emits a signal to detect the presence or absence of liquid in the cylinder, adjacent to the sensor.

8. The device claimed in claim 5 wherein said valve is opened and closed by an electric solenoid which is included in said valve circuit.

9. The device claimed in claim 5 wherein said sensor is connected between two terminals in said valve circuit, wherein said sensor electrically connects said terminals when it senses a full reservoir condition and wherein said sensor electrically disconnects said terminals when it does not sense a full reservoir condition.

10. A voltage block device for receiving a conductive coating material at substantially ground potential and for dispensing the coating material to an electrostatic spray head which, when actuated, is charged by a power supply, said device comprising a cylinder having upper and lower ends, said cylinder being composed of non-conductive material, upper and lower caps secured to the ends of the cylinder to define a closed space therein, a discharge outlet secured in said lower cap, said outlet being operable to dispense conductive coating material for delivery to an electrostatic spray head, a valve secured in said upper cap and having an inlet for receiving conductive coating material under pressure at substantially ground potential and an outlet for discharging said conductive coating material into said closed space, a sensor for sensing when the cylinder contains a full reservoir of coating material, wherein said full reservoir of coating material has an upper surface which is spaced a distance D from the upper cap, a pressure regulator for receiving compressed gas and delivering it into the closed space to maintain a pressure therein, a timer operable to repeatably create a first signal of a duration O and a second signal of a duration C, switch means for selecting between operation of the device in a first mode and a second mode, a valve circuit including said sensor and said switch means and operable, in the first mode of operation, to open said valve so that a stream of conductive coating material is dispensed into said cylinder where it falls into the reservoir of conductive coating material, only when said sensor senses that the cylinder contains less than a full reservoir of coating material and the spray head is not being charged by said power supply, said valve circuit being further operable, in said first mode of operation, to close said valve whenever said sensor senses that the cylinder contains a full reservoir of coating material or the spray head is being charged by said power supply, wherein, when said valve is closed in said first mode of operation, an air gap having a length corresponding with said distance D is maintained in the device and wherein said air gap is sufficiently long to prevent the leakage of potential from the reservoir of coating material to said upper cap and said valve, said valve circuit being operable, in the second mode of operation, when said sensor senses that the cylinder contains less than a full reservoir of coating material, to repeatedly open said valve and keep it open for a length of time equal to the duration O and to close said valve and keep it closed for a length of time equal to the duration C, so that discreet bodies of conductive coating material are dispensed into said cylinder where they fall into the reservoir of conductive coating material in the lower end of the cylinder, said bodies, while falling, each having a substantially uniform length of B, wherein, at all times when said valve is dispensing such bodies in said second mode of operation, the distance D minus the combined length B of all bodies which are falling in the cylinder equals a distance corresponding with the total air gap in the device and wherein said total air gap is sufficiently long that it prevents the leakage of potential from the reservoir of coating material to said upper cap and said valve when the electrostatic spray head is actuated and is being charged by the power supply.

11. The device claimed in claim 10 which further includes means for adjusting the duration of said first and second signals created by said timer.

12. The device claimed in claim 10 wherein said sensor is secured to the device, outside of the cylinder and wherein said sensor is a capacitance type which emits a signal to detect the presence or absence of liquid in the cylinder, adjacent to the sensor.

13. The device claimed in claim 10 wherein said valve is opened and closed by an electric solenoid which is included in said valve circuit.

14. The device claimed in claim 10 wherein said sensor is connected between two terminals in said valve circuit, wherein said sensor electrically connects said terminals when it senses a full reservoir condition and wherein said sensor electrically disconnects said terminals when it does not sense a full reservoir condition.

* * * * *

UNITED STATES PATENT AND TRADEMARK OFFICE

CERTIFICATE OF CORRECTION

PATENT NO. : 5,518,186

DATED : May 21, 1996

INVENTOR(S) : Richard Weinstein

It is certified that error appears in the above-identified patent and that said Letters Patent is hereby corrected as shown below:

Column 1, Line 18 should read:
paint application. In electrostatic spraying apparatus, paint Column 1, Line 28 should read:
from an electrically grounded paint pot to a charged spray Signed and Sealed this Twentieth Day of August, 1996

*Attest:*

Bruce Lehman

BRUCE LEHMAN

*Attesting Officer*

*Commissioner of Patents and Trademarks*